US010384139B2

(12) United States Patent
Van Dan Elzen

(10) Patent No.: US 10,384,139 B2
(45) Date of Patent: Aug. 20, 2019

(54) MOTORIZED YO-YO

(71) Applicant: Hans W. Van Dan Elzen, Gilbert, AZ (US)

(72) Inventor: Hans W. Van Dan Elzen, Gilbert, AZ (US)

( * ) Notice: Subject to any disclaimer, the term of this patent is extended or adjusted under 35 U.S.C. 154(b) by 0 days.

(21) Appl. No.: 16/148,139

(22) Filed: Oct. 1, 2018

(65) Prior Publication Data

US 2019/0030443 A1 Jan. 31, 2019

Related U.S. Application Data

(63) Continuation-in-part of application No. 15/692,809, filed on Aug. 31, 2017, now Pat. No. 10,086,301.

(60) Provisional application No. 62/384,909, filed on Sep. 8, 2016.

(51) Int. Cl.

| | |
|---|---|
| ***A63H 1/30*** | (2006.01) |
| ***A63H 1/24*** | (2006.01) |
| ***A63H 29/22*** | (2006.01) |
| ***A63H 33/22*** | (2006.01) |

(52) U.S. Cl.
CPC ..... *A63H 1/30* (2013.01); *A63H 1/24* (2013.01); *A63H 29/22* (2013.01); *A63H 33/22* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,634,922 | B1 * | 10/2003 | Driscoll | A63H 1/30 273/142 R |
| 7,448,934 | B2 * | 11/2008 | Van Dan Elzen | A63H 1/30 446/236 |
| 8,187,052 | B2 * | 5/2012 | Van Dan Elzen | A63H 1/30 446/247 |
| 2005/0048869 | A1 * | 3/2005 | Osawa | A63H 1/06 446/250 |

* cited by examiner

*Primary Examiner* — John A Ricci
(74) *Attorney, Agent, or Firm* — Barnes & Thornburg LLP; Mark J. Nahnsen

(57) ABSTRACT

A motorized yo-yo includes a body and a tether coupled to the body to support the body for rotation. A drive mechanism of the body drives rotation of the body when a user throws the yo-yo.

20 Claims, 11 Drawing Sheets

MOTORIZED YO-YO

PRIORITY CLAIM

This application is a continuation-in-part of co-pending U.S. patent application Ser. No. 15/692,809, filed Aug. 31, 2017, which is expressly incorporated by reference herein. This application also claims priority under 35 U.S.C. § 119(e) to U.S. Provisional Patent Application No. 62/384,909, filed Sep. 8, 2016, which is expressly incorporated by reference herein.

BACKGROUND

The present disclosure relates to a yo-yo, and particularly to a motorized yo-yo. More particularly, the present disclosure relates to a yo-yo having a motor to continuously spin the yo-yo.

SUMMARY

According to the present disclosure, a motorized yo-yo includes a body and a tether coupled to the body to support the body for rotation. The body includes a drive-side housing coupled to a power-side housing by an axle.

In illustrative embodiments, a drive mechanism is coupled to the drive-side housing and a power supply is coupled to the power-side housing. The drive mechanism engages with an anchor supported by the tether. The power supply delivers power to the drive mechanism to drive rotation of the body relative to the anchor.

In illustrative embodiments, a rotation controller is coupled to the drive mechanism and the power supply. The rotation controller controls delivery of power to the drive mechanism to control rotation of the body. The rotation controller detects when the yo-yo has been thrown and in which direction the body is rotating.

In illustrative embodiments, a control circuit coupled to the motor and the power supply includes rotation detectors. The rotation detectors sense which direction the body is rotating and cause power to be supplied to the drive mechanism to drive the body in the same direction of rotation. A centrifugal switch of the circuit closes when the yo-yo is thrown to allow power to be supplied to the drive mechanism, and opens when the yo-yo is returned to cut power from the drive mechanism.

In illustrative embodiments, the rotation controller is configured to pulse the application of voltage to the drive mechanism to intermittently stop the application of force to the anchor by the drive mechanism in the direction of rotation.

In illustrative embodiments, the control circuit includes a contact arranged in series with the rotation detectors, a relay, and an oscillator coupled to the relay. The contact is configured to open in response to signals from the relay and stop application of voltage to the drive mechanisms. The oscillator is configured to selectively and intermittently power the relay to produce the signals.

In illustrative embodiments, a selector is coupled to the body and operatively connected to the rotation controller. The selector is configured to be engaged by a user to allow a user to select a predetermined amount of time. The rotation controller is configured to supply voltage to the drive mechanism for the predetermined amount of time at the selection of a user.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
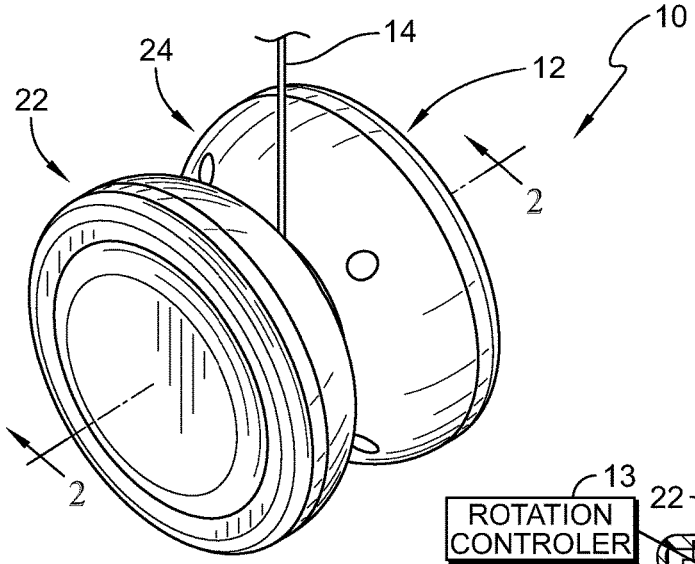
FIG. 1 is a perspective view of a motorized yo-yo in accordance with the present disclosure showing that the yo-yo includes a body and a tether and suggesting that the tether supports the body after being thrown by a user to rotate the body.

A motorized yo-yo 10 in accordance with the present disclosure is shown in FIG. 1. Motorized yo-yo 10 includes a body 12 and a tether 14 configured to support body 12 for rotation about an axis A as suggested in FIG. 2. Body 12 includes a drive-side housing 22 coupled to a power-side housing 24 by an axle 16. Tether 14 is coupled to an anchor 18 which is configured to support body 12 and allow rotation of body 12 relative to tether 14 about axis A.

Figure 2:
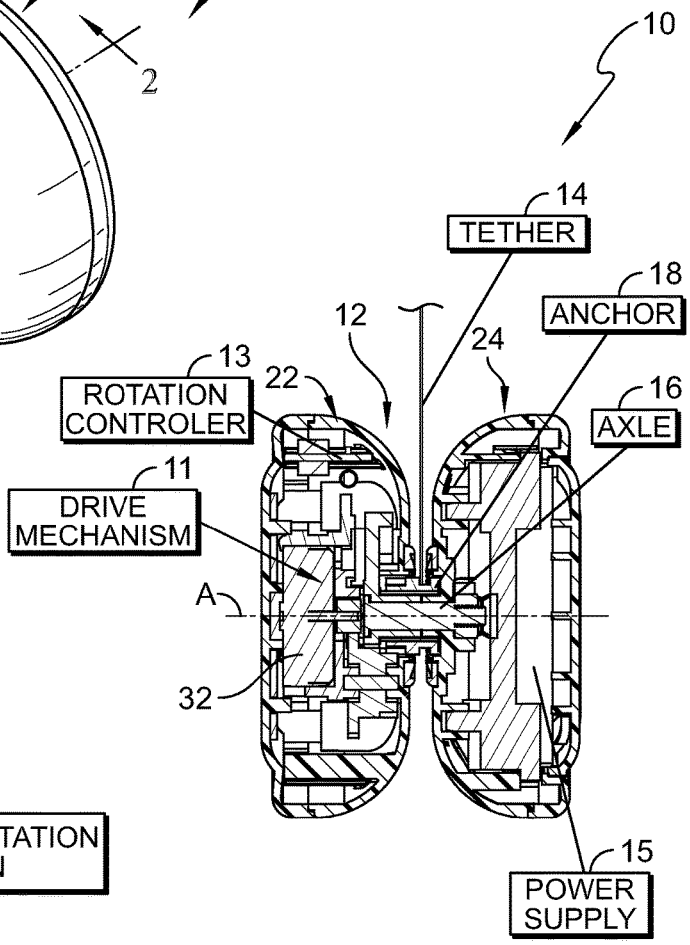
FIG. 2 is a sectional view taken along line 2-2 in FIG. 1 showing that the body includes a drive-side housing and a power-side housing coupled together by an axle and suggesting that a drive mechanism is used to rotate the body about an axis (A) through the axle relative to an anchor coupled to the tether.
Figure 3:
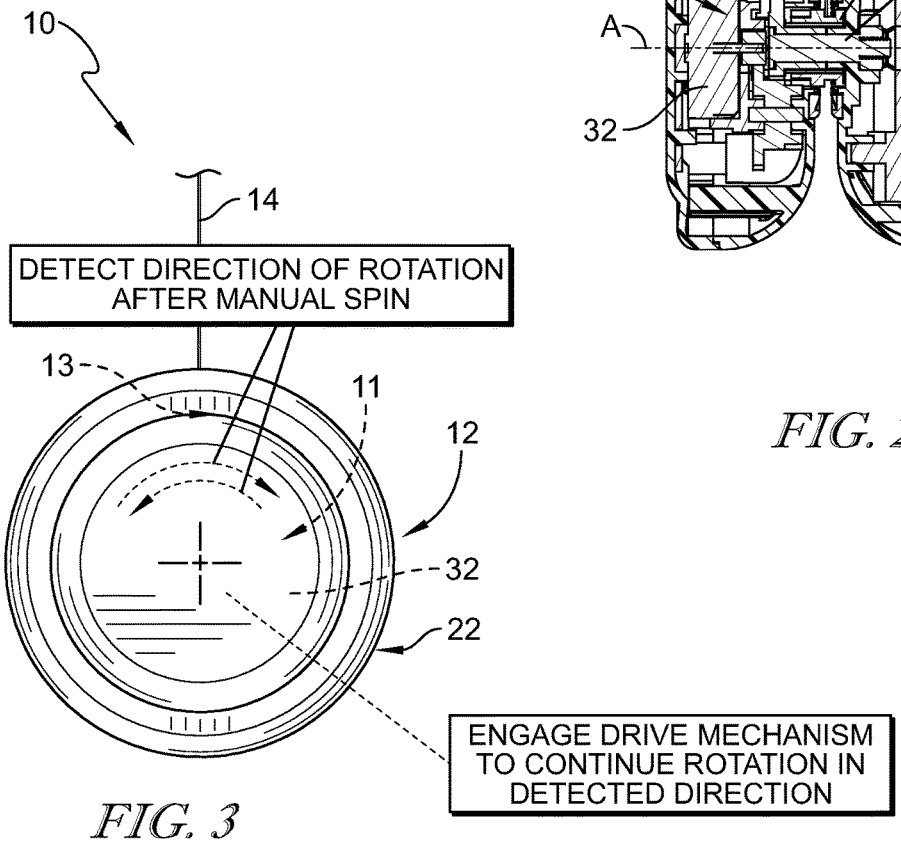
FIG. 3 is a side elevation view of the yo-yo of FIG. 2 showing the body supported by the tether and suggesting that a direction of rotation of the body after being thrown is detected and that the drive mechanism is engaged to drive the body to rotate in the detected direction.

A drive mechanism 11 engages with anchor 18 and is configured to drive rotation of body 12 relative to anchor 18 as suggested in FIG. 2. A rotation controller 13 in accordance with the present disclosure is configured to detect a direction of rotation of body 12 after being thrown down on tether 14 by a user and to engage drive mechanism 11 to continue rotation of body 12 in the detected direction of rotation as suggested in FIG. 3. A power supply 15 delivers power to rotation controller 13, as suggested in FIG. 2, and rotation controller 13 selectively supplies positive or negative voltage to a motor 32 of drive mechanism 11 depending on the detected direction of rotation of body 12.

Figure 4:
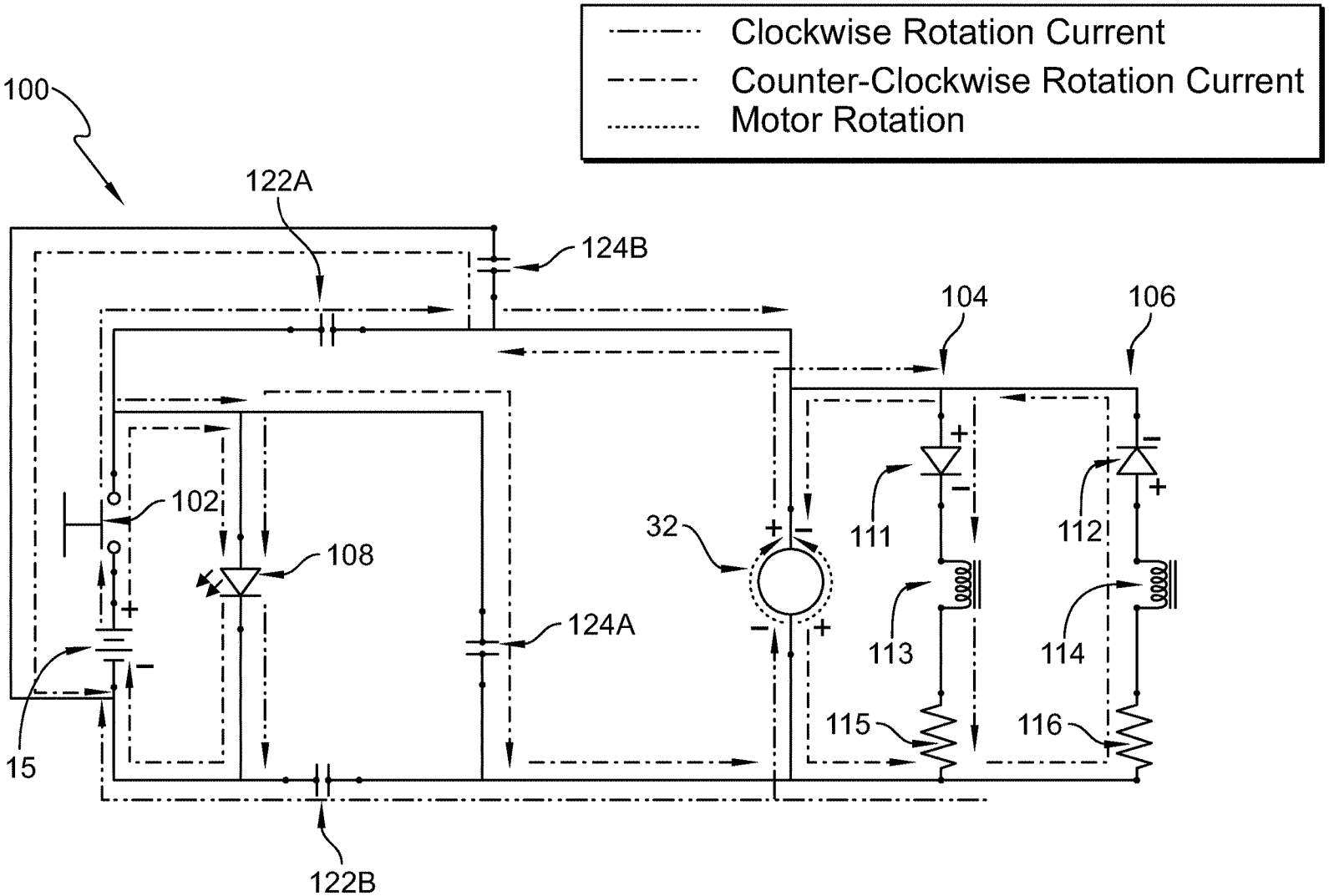
FIG. 4 is a schematic view of one embodiment of a control circuit used to detect a direction of rotation of the body and deliver power from a power supply to the drive mechanism to drive the body in the detected direction.

One embodiment of a control circuit 100 for use in motorized yo-yo 10 is shown in FIG. 4. In the illustrative embodiment, motor 32 acts as a generator and produces electrical voltage when the body 12 is initially thrown. The polarity of the voltage produced by motor 32 changes depending on the direction of rotation of body 12, and thereby motor 32.

Control circuit 100 includes a clockwise rotation detector 104 and a counter-clockwise rotation detector 106 coupled to motor 32 as suggested in FIG. 4. A diode 111, 112 of each detector 104, 106, respectively, only allows current to flow through the detector 104, 106 in a single direction. For example, a clockwise rotation of motor 32 produces a current, which flows from the positive side (+) of the motor 32 to the negative side (−), as represented by a double short-dashed line in FIG. 4. Diode 111 allows the current to flow through detector 104 because it is flowing from the positive end (+) of the diode 111 to the negative end (−). Diode 112 blocks the flow of current through detector 106 because the ends are reversed.

Similarly, a counter-clockwise rotation of motor 32 produces a current, which flows from the positive side (+) of the motor 32 to the negative side (−), as represented by a single short-dashed line in FIG. 4. Diode 112 allows the current to flow through detector 106 because it is flowing from the positive end (+) of the diode 112 to the negative end (−). Diode 111 blocks the flow of current through detector 104 because the ends are reversed.

A centrifugal switch 102 closes when body 12 is thrown down by a user to connect power supply 15 with the rest of circuit 100 as suggested in FIG. 4. In the illustrative embodiment, a relay coil 113 of detector 104 closes contacts 122A, 122B to allow power from power supply 15 to flow to motor 32 when a clockwise rotation is detected, as suggested by the double short-dashed line in FIG. 4. The supplied power turns motor 32 from a generator into a driver to cause the motor 32 to continue to rotate in the clockwise direction, and thereby continue rotation of body 12.

Likewise, a relay coil 114 of detector 106 closes contacts 124A, 124B to allow power from power supply 15 to flow to motor 32 when a counter-clockwise rotation is detected, as suggested by the single short-dashed line in FIG. 4. The supplied power turns motor 32 from a generator into a driver to cause the motor 32 to continue to rotate in the counter-clockwise direction, and thereby continue rotation of body 12. Resistors 115, 116 of each detector 104, 106, respectively, limit the current flowing through relays 113, 114. In some embodiments, relays 113, 114 are mechanical relays.

A lamp 108, such as a light emitting diode (LED), turns on when centrifugal switch 102 closes to show that power is being supplied to motor 32 as suggested in FIG. 4. Centrifugal switch 102 opens when body 12 is returned to the user's hand, and power from power supply 15 is disengaged from the circuit 100 to stop driving motor 32. With the motor 32 not spinning, relay coils 113, 114 are de-energized such that contacts 122A, 122B, 124A, 124B open to reset the circuit 100.

Figure 5:
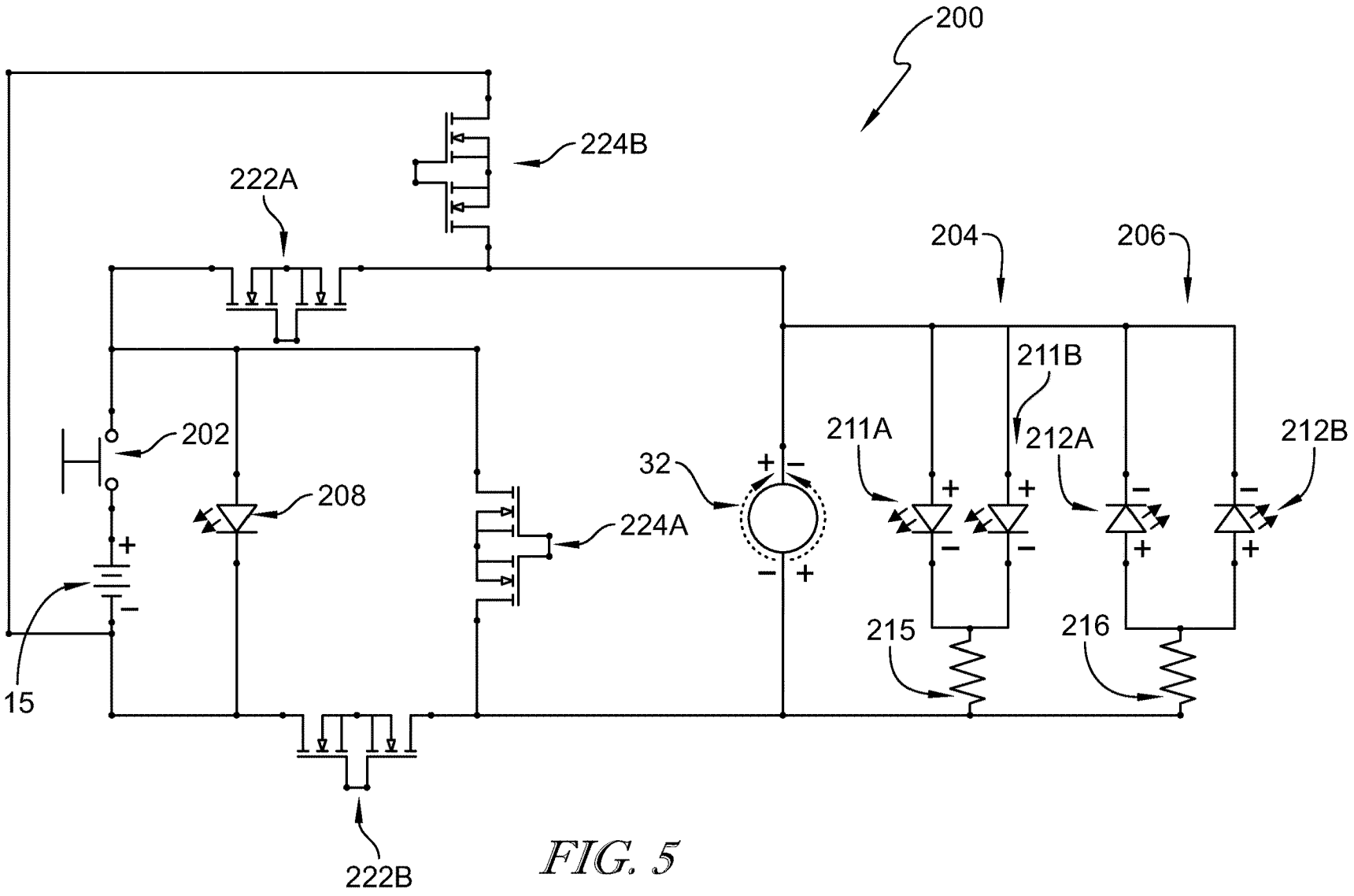
FIG. 5 is a schematic view of another embodiment of a rotation controller circuit used to detect a direction of rotation of the body and deliver power from a power supply to the drive mechanism to drive the body in the detected direction.

Another embodiment of a control circuit 200 for use in motorized yo-yo 10 is shown in FIG. 5. Control circuit 200 is similar to control circuit 100 where the flow of current through circuit 200 is dictated by the direction of rotation of motor 32. In some embodiments, control circuit 200 is part of a solid-state device coupled to power supply 15 and motor 32.

In the illustrative embodiment, control circuit 200 includes a clockwise rotation detector 204 and a counter-clockwise rotation detector 206 coupled to motor 32. A pair of LEDs 211A, 211B of detector 204, and a pair of LEDs 212A, 212B of detector 206, only allow current to flow through the detector 204, 206 in a single direction. For example, a clockwise rotation of motor 32 produces a current, which flows from the positive side (+) of the motor 32 to the negative side (−), similar to the double short-dashed line in FIG. 4. The LEDs 211A, 211B allow the current to flow through detector 204 because it is flowing from the positive ends (+) of the LEDs 211A, 211B to the negative ends (−). LEDs 212A, 212B block the flow of current through detector 206 because the ends are reversed.

Likewise, a counter-clockwise rotation of motor 32 produces a current, which flows from the positive side (+) of the motor 32 to the negative side (−), similar to the single short-dashed line in FIG. 4. LEDs 212A, 212B allows the current to flow through detector 206 because it is flowing from the positive ends (+) of the LEDs 212A, 212B to the negative ends (−). LEDs 211A, 211B block the flow of current through detector 204 because the ends are reversed.

A centrifugal switch 202 closes when body 12 is thrown down by a user to connect power supply 15 with the rest of circuit 200 as suggested in FIG. 5. In the illustrative embodiment, contacts 222A, 222B are metal oxide semiconductor field effect transistors (MOSFETs) which are in a normally open state when de-energized. LEDs 211A, 211B illuminate to energize contacts 222A, 222B, respectively, and switch contacts 222A, 222B to a closed state to allow power from power supply 15 to flow to motor 32 when a clockwise rotation is detected, similar to control circuit 100. The supplied power turns motor 32 from a generator into a driver to cause the motor 32 to continue to rotate in the clockwise direction, and thereby continue rotation of body 12.

Likewise, LEDs 212A, 212B illuminate to energize contacts 224A, 224B, respectively, and switch contacts 224A, 224B to a closed state to allow power from power supply 15 to flow to motor 32 when a counter-clockwise rotation is detected, similar to control circuit 100. The supplied power turns motor 32 from a generator into a driver to cause the motor 32 to continue to rotate in the counter-clockwise direction, and thereby continue rotation of body 12. Resistors 215, 216 of each detector 204, 206, respectively, limit the current flowing through detectors 204, 206.

A lamp 208, such as an LED, turns on when centrifugal switch 202 closes to show that power is being supplied to motor 32 as suggested in FIG. 5. Centrifugal switch 202 opens when body 12 is returned to the user's hand, and power from power supply 15 is disengaged from the circuit 200 to stop driving motor 32. With the motor 32 not spinning, LEDs 211A, 211B, 212A, 212B are de-energized such that contacts 222A, 222B, 224A, 224B switch to the open state to reset the circuit 200.

Figure 6:
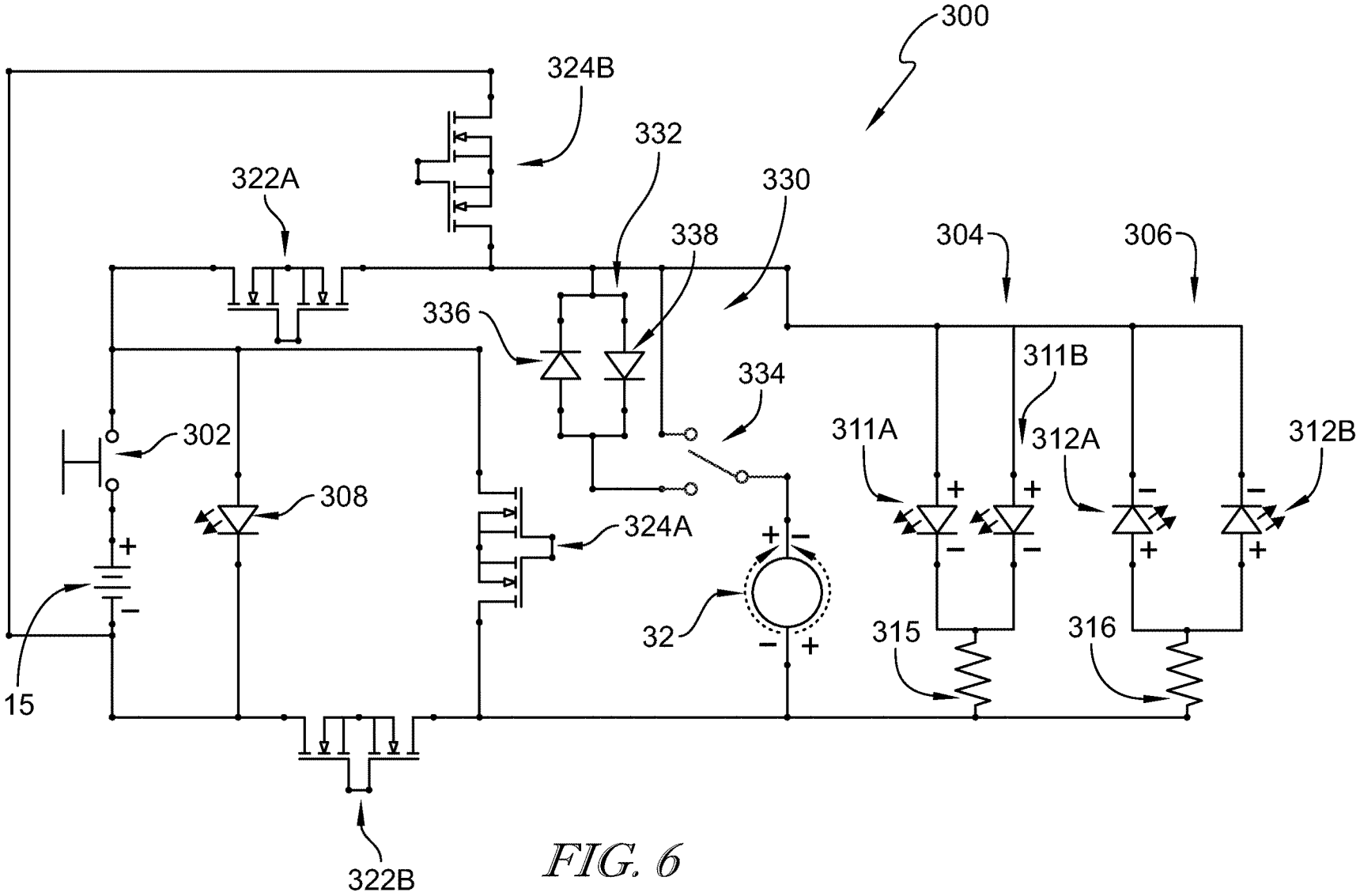
FIG. 6 is a schematic view of another embodiment of a rotation controller circuit used to detect a direction of rotation of the body and deliver power from a power supply to the drive mechanism to drive the body in the detected direction and also used to select a rotation speed.

Another embodiment of a control circuit 300 for use in motorized yo-yo 10 is shown in FIG. 6. Control circuit 300 is similar to control circuit 200. The description of circuit 200 also applies to the circuit 300 and similar numbers in the 300 series are used to describe similar components.

In the illustrative embodiment, control circuit 300 also includes a speed controller 330 as shown in FIG. 6. Speed controller 330 includes a selector switch 334 and a voltage reducer 332. In a "fast" position of switch 334, current bypasses voltage reducer 332 so that the full voltage supplied by power supply 15 is provided to motor 32, and the motor 32 turns with a corresponding maximum speed. In a "slow" position of switch 334, current runs through voltage reducer 332 so that a reduced voltage is provided to motor 32, and the motor 32 turns with a corresponding reduced speed.

Voltage reducer 332 includes a pair of oppositely oriented diodes 336, 338 corresponding to the opposing current flows which can be produced by circuit 300 as suggested in FIG. 6. Diodes 336, 338 cause a reduction in voltage as current flows across the diode without causing a reduction in the current flow. The reduced voltage supplied to the motor 32 causes the motor 32 to rotate slower. In some embodiments, the user engages the switch 334 to change the rotational speed of the body 12.

Figure 7:
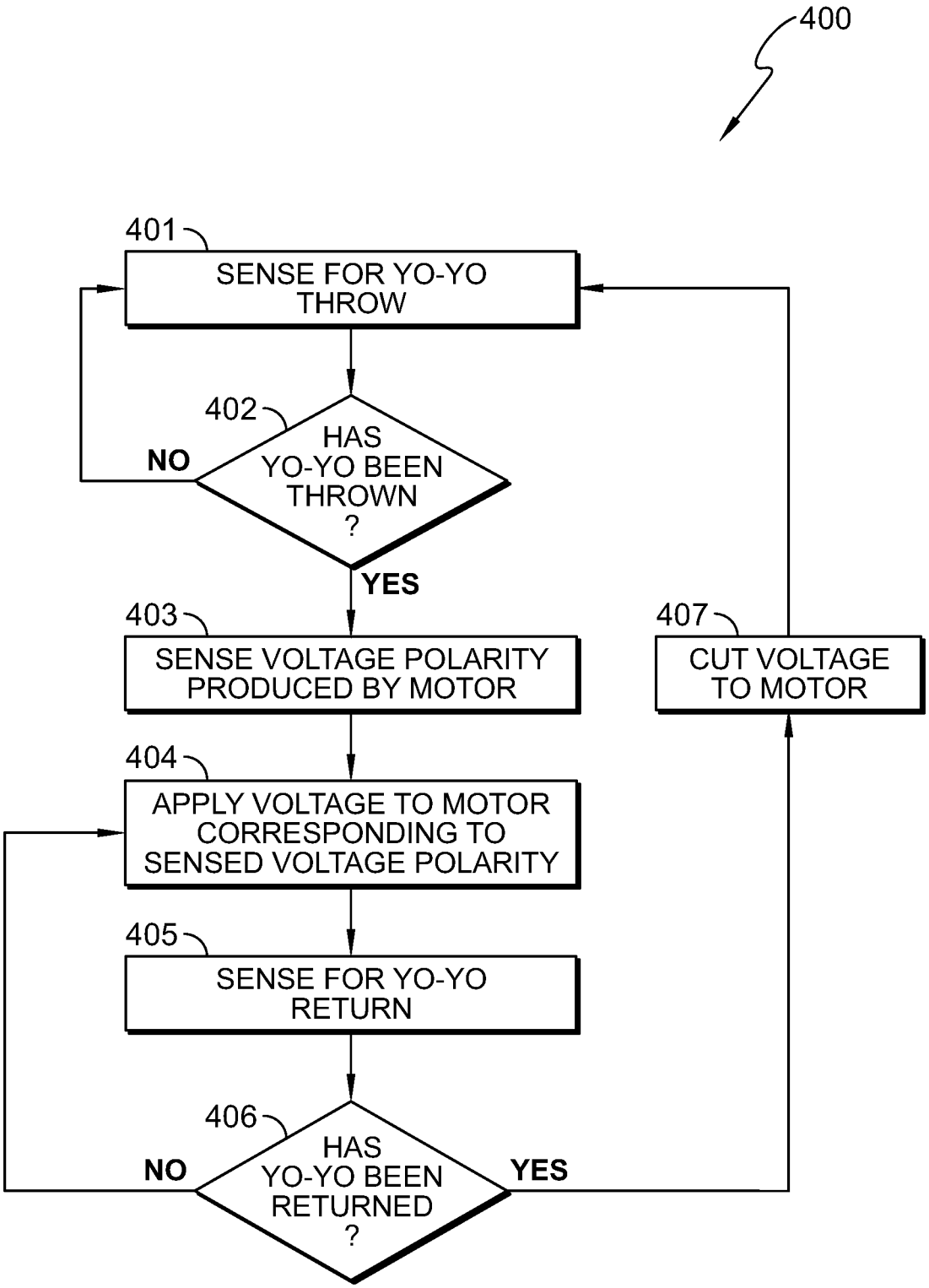
FIG. 7 is a diagrammatic view of an illustrative process for operating the rotation controller of the yo-yo of FIG. 1.

An illustrative process 400 for operating the rotation controller 13 of the yo-yo 10 is shown in FIG. 7. The process 400 starts at 401 where rotation controller 13 senses whether the yo-yo 10 is "thrown" by the user, such as when the body 12 is dropped to unravel the tether 14 to cause the body 12 to begin rotating. In some embodiments, the centrifugal switch 102, 202, 302 is used to sense for whether the yo-yo 10 has been thrown.

If the yo-yo 10 has been thrown, the polarity of the voltage produced by motor 32 is sensed as suggested at 402-403 in FIG. 7. In some embodiments, detectors 104, 106, 204, 206, 304, 306 are used to sense the polarity of the voltage produced by the motor 32. Voltage from the power supply 15 is then applied to the motor 32 corresponding to the sensed voltage as suggested at 404.

If the yo-yo 10 has not been "returned", such as by winding up the tether 14 around the anchor 18 to bring the body 12 to the user's hand, then voltage is continuously supplied by the power supply 15 to the motor 32 for as long as the power supply 15 holds a charge as suggested at 404-406 in FIG. 7. If the yo-yo 10 has been returned, then voltage from the power supply is cut from the motor 32 as suggested at 407, and the next throw of yo-yo 10 is sensed for as suggested at 401. In some embodiments, opening of the centrifugal switch 102, 202, 302, cuts voltage to the motor 32 when the yo-yo 10 is returned. In some embodiments, an "on-off" switch is included in the yo-yo 10 to allow a user to select when the drive mechanism 11 operates so that the yo-yo 10 can be used as a non-powered yo-yo.

Figure 8:
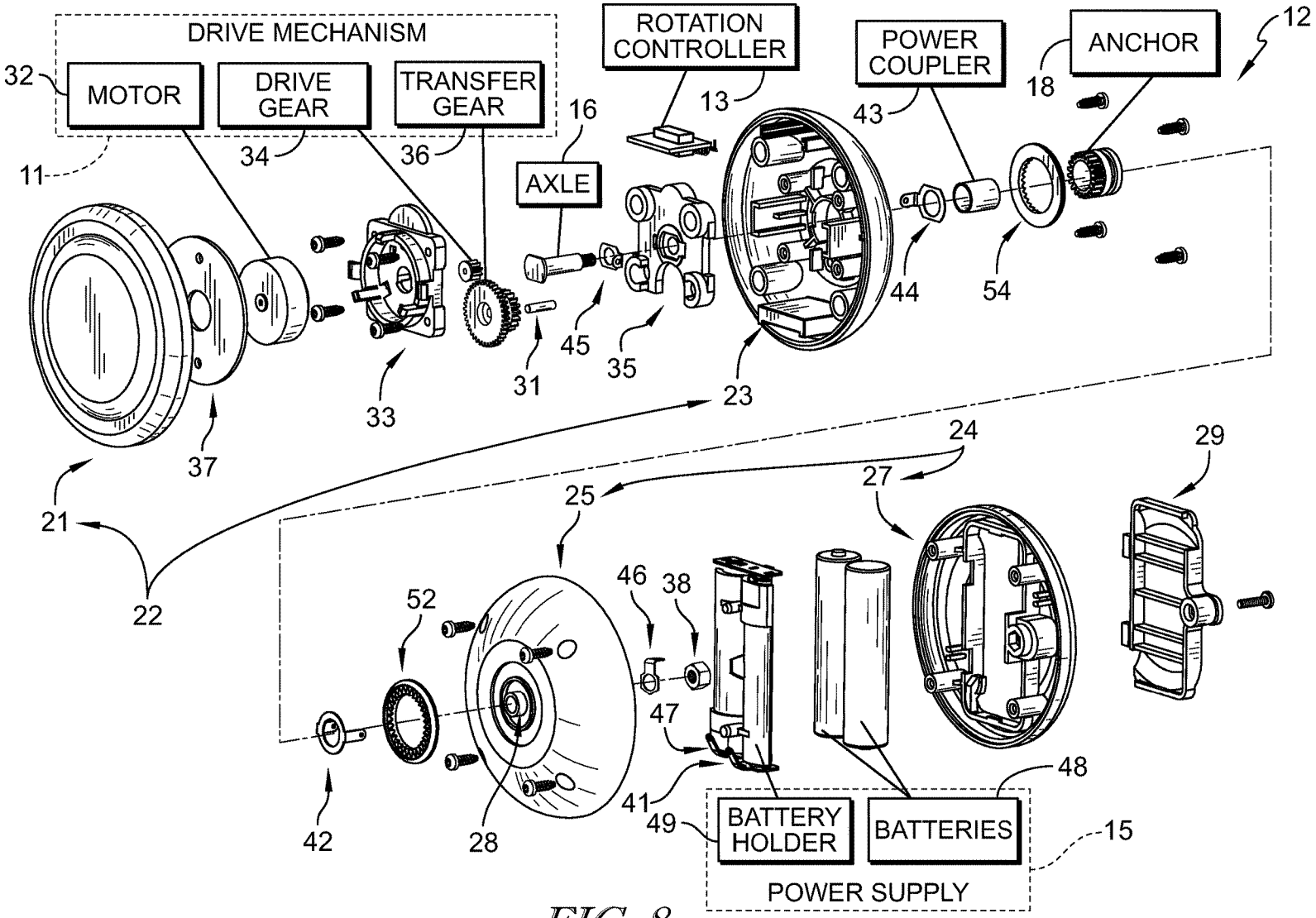
FIG. 8 is an exploded perspective view of the body of the yo-yo of FIG. 2 showing that the drive mechanism includes a motor, a drive gear, and a transfer gear and suggesting that the drive gear engages with a transfer gear to direct power from the motor through the transfer gear to the anchor to rotate the body relative to the anchor.
Figure 9:
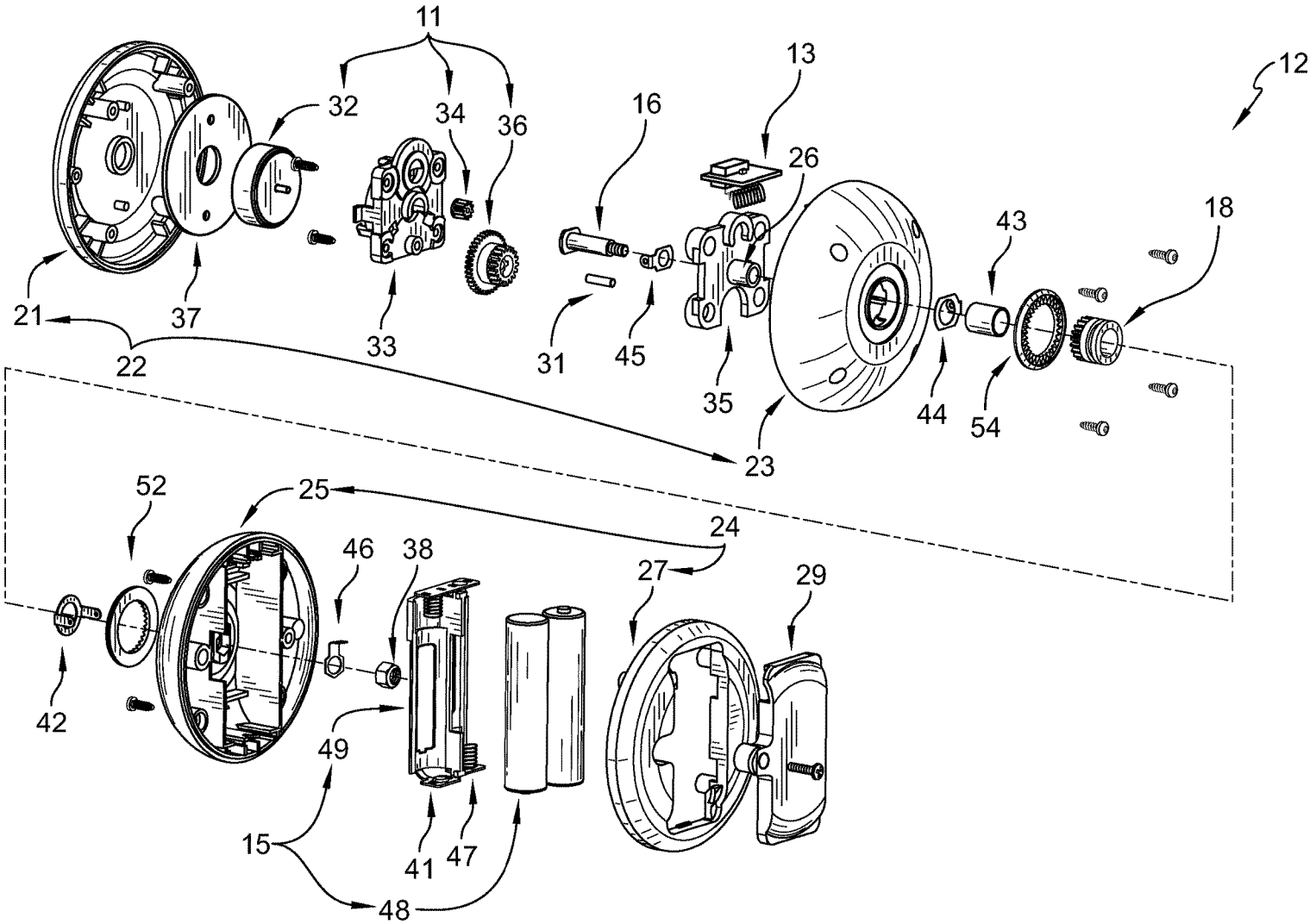
FIG. 9 is a view similar to FIG. 8.

Body 12 of yo-yo 10 includes the drive-side housing 22 coupled to the power-side housing 24 by the axle 16 as suggested in FIGS. 8 and 9. Drive-side housing 22 includes a shell 23 configured to hold drive mechanism 11 and a cover 21 configured to couple with shell 23 to close an interior of shell 23. In some embodiments, cover 21 is secured to shell 23 with fasteners, such as screws or bolts.

Drive mechanism 11 includes the motor 32, a drive gear 34 coupled to the motor 32, and a transfer gear 36 as suggested in FIGS. 8 and 9. Motor 32 is received in a motor mount 33, and a pin 31 engages with motor mount 33 and shell 23 to hold transfer gear 36 against drive gear 34. Transfer gear 36 also engages with anchor 18 such that rotation of motor 32 causes body 12 to rotate around anchor 18.

Power-side housing 24 includes a shell 25 configured to hold power supply 15 and a cover 27 configured to couple with shell 25 to close an interior of shell 25 as suggested in FIGS. 8 and 9. In some embodiments, cover 27 is secured to shell 25 with fasteners, such as screws or bolts. In the illustrative embodiment, power supply 15 includes a battery holder 49 and batteries 48 coupled to battery holder 49. Batteries 48 can be replaced by a user when the batteries 48 run out of power by removing a closure 29 of cover 27. In some embodiments, batteries 48 are permanently mounted in power-side housing 24, and an external charger is used to resupply the batteries with power.

Power is supplied from power-side housing 24 to drive-side housing 22 through a power circuit of electrically conductive components 41-47 as suggested in FIGS. 8 and 9. A positive lead 41 of power supply 15 is coupled to a power-side delivery contact 42. A power coupler 43 engages with power-side delivery contact 42 and a drive-side delivery contact 44. Drive-side delivery contact 44 is coupled to rotation controller 13 such that power is delivered to rotation controller 13 through electrically conductive components 41-44.

The return portion of the power circuit includes electrically conductive components 45-47 as suggested in FIGS. 8 and 9. A drive-side return contact 45 is coupled to rotation controller 13. In the illustrative embodiment, axle 16 is electrically conductive and extends through drive-side return contact 45. Axle 16 extends through a neck 26 of an adapter plate 35 and through a sleeve 28 of shell 25 to electrically isolate axle 16 from components 42-44 which extend around an exterior of neck 26 and sleeve 28. Axle 16 extends through a power-side return contact 46 and engages with a nut 38 to hold power-side housing 24 and drive-side housing 22 together. Power-side return contact 46 is coupled to a negative lead 47 of power supply 15 to complete the power circuit.

In the illustrative embodiment, motor mount 33 couples to adapter plate 35 with fasteners, such as screws or bolts, as suggested in FIGS. 8 and 9. Drive mechanism 11 and rotation controller 13 are received in shell 23 and retained by cover 21. Rotation controller 13 is coupled to motor 32 to supply power to motor 32 as received through the power circuit from power supply 15. In some embodiments, body 12 also includes a balance plate 37 to balance the weight of power-side housing 24 and drive-side housing 22. In some embodiments, body 12 also includes tether grips 52, 54 which are configured to engage with tether 14 to make returning the yo-yo 10 easier for a user.

Figure 10:
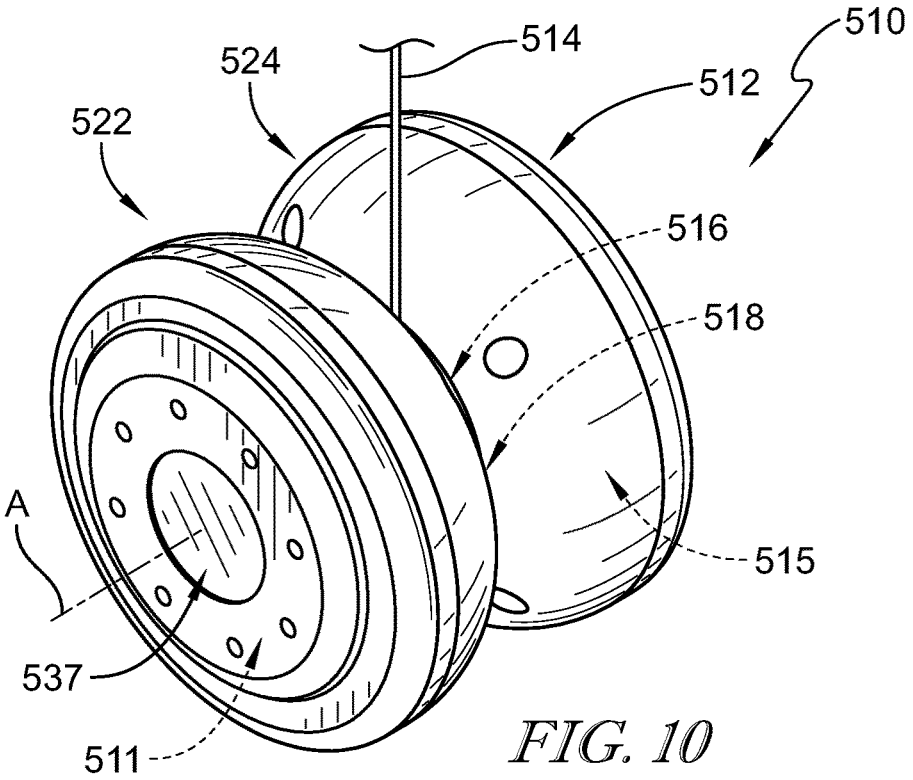
FIG. 10 is a perspective view of another embodiment of a motorized yo-yo in accordance with the present disclosure showing that the yo-yo includes a body and a tether and suggesting that the tether supports the body after being thrown by a user to rotate the body about an axis (A)
Figure 11:
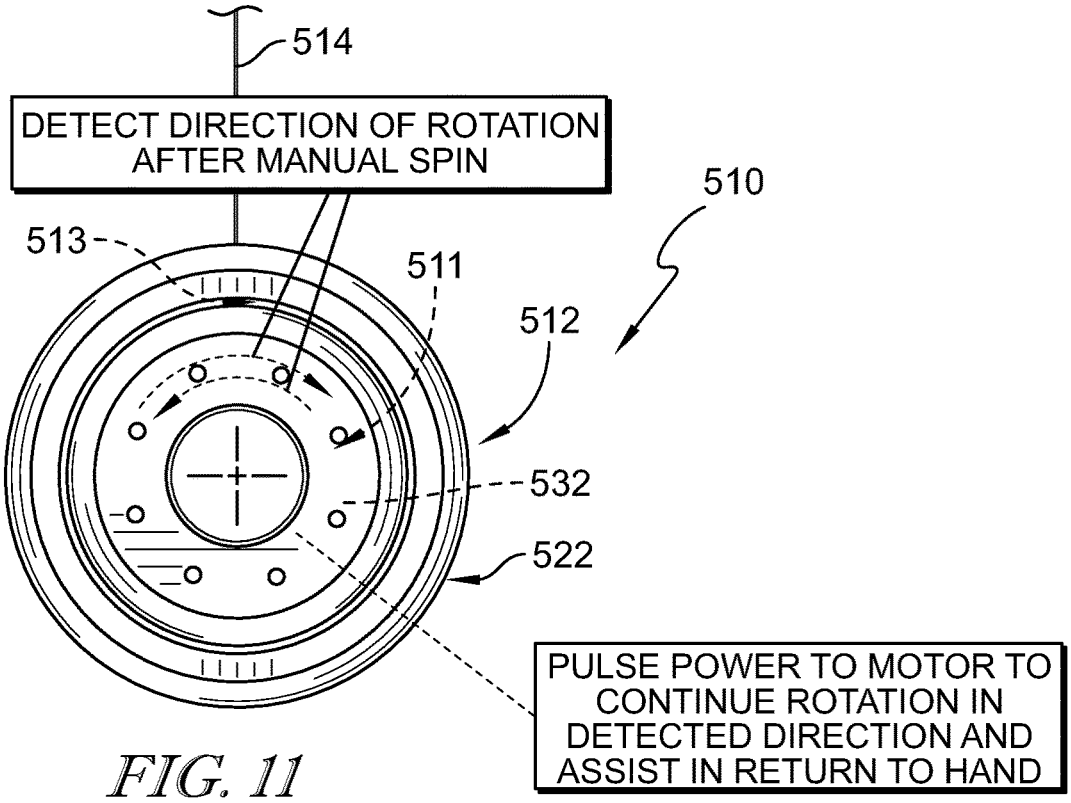
FIG. 11 is a side elevation view of the motorized yo-yo of FIG. 1 showing the body supported by the tether and suggesting that a direction of rotation of the body after being thrown is detected and that power is pulsed to a motor to drive the body to rotate in the detected direction and to assist in return of the motorized yo-yo to a user's hand.

Another embodiment of a motorized yo-yo 510 in accordance with the present disclosure is shown in FIGS. 10 and 11. Motorized yo-yo 510 is substantially similar to motorized yo-yo 10 shown in FIGS. 1-3 and 8-9 and described herein. Accordingly, similar reference numbers in the 500 series indicate features that are common between motorized yo-yo 10 and motorized yo-yo 510. The description of motorized yo-yo is incorporated by reference to apply to motorized yo-yo 510, except in instances when it conflicts with the specific description and the drawings of motorized yo-yo 510.

Motorized yo-yo 510 includes a body 512 and a tether 514 configured to support body 512 for rotation about an axis A as suggested in FIG. 10. Body 512 includes a drive-side housing 522 coupled to a power-side housing 524 by an axle 516. Tether 514 is coupled to an anchor 518 which is configured to support body 512 and allow rotation of body 512 relative to tether 514 about axis A.

A drive mechanism 511 engages with anchor 518 and is configured to drive rotation of body 512 relative to anchor 518 as suggested in FIG. 10. A rotation controller 513 in accordance with the present disclosure is configured to detect a direction of rotation of body 512 after being thrown down on tether 514 by a user and to engage drive mechanism 511 to continue rotation of body 512 in the detected direction of rotation as suggested in FIG. 11. A power supply 515 delivers power to rotation controller 513, as suggested in FIG. 10, and rotation controller 513 selectively supplies positive or negative voltage to a motor 532 of drive mechanism 511 depending on the detected direction of rotation of body 512, as suggested in FIG. 11.

In the illustrative embodiment, rotation controller 513 applies power from power supply 515 to motor 532 in pulses with intermittent breaks in the application of power as suggested in FIG. 11. Drive mechanism 511 places a force on anchor 518 and tether 514 to rotate body 512. In some circumstances, the force placed on anchor 518 and tether 514 by drive mechanism 511 can cause tether 514 to resist winding around body 512 and returning to a user's hand. Pulsing power to motor 532 can assist in returning body 512 to a user's hand by alleviating counteracting forces on tether 514 and allow tether 514 to wind around body 512.

Figure 12A:
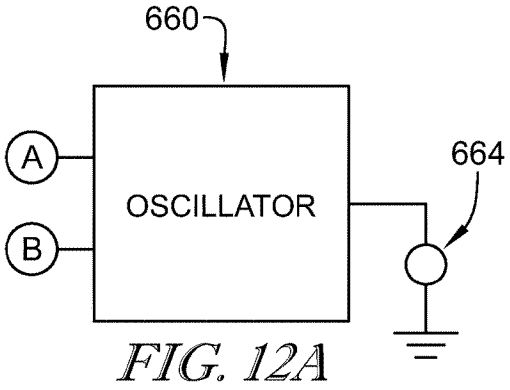
FIG. 12A is a diagrammatic view of an oscillator for use with the rotation controller circuit of FIG. 12 to pulse power delivered to the motor.
Figure 12:
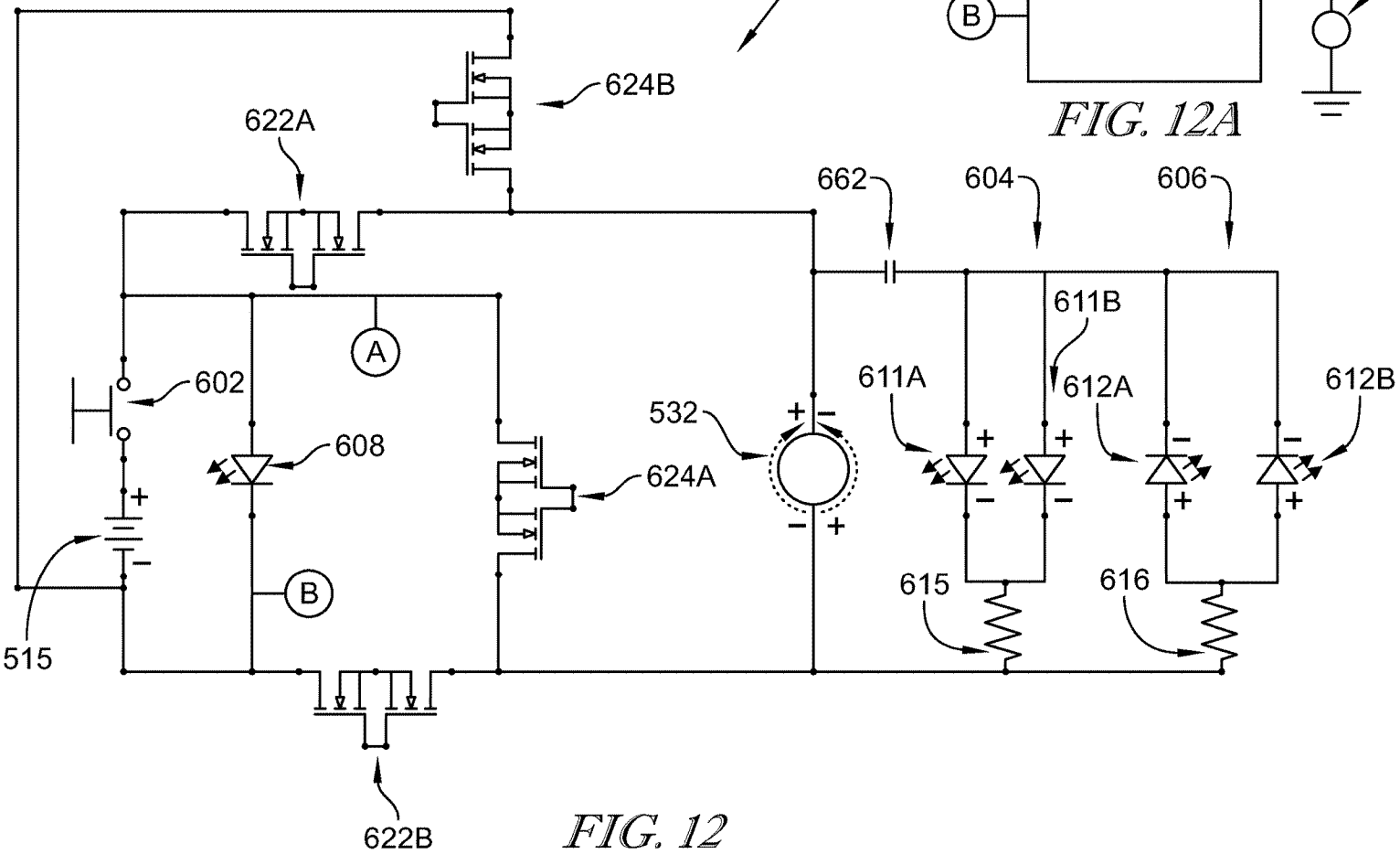
FIG. 12 is a schematic view of another embodiment of a rotation controller circuit in accordance with the present disclosure used to detect a direction of rotation of the body and deliver power from a power supply to the motor to drive the body in the detected direction.

One embodiment of a control circuit 600 in accordance with the present disclosure for use in motorized yo-yo 510 is shown in FIG. 12. Control circuit 600 is substantially similar to control circuit 200 shown in FIG. 5 and described herein. Accordingly, similar reference numbers in the 600 series indicate features that are common between control circuit 600 and control circuit 200. The description of control circuit 200 is incorporated by reference to apply to control circuit 600, except in instances when it conflicts with the specific description and the drawings of control circuit 600.

In the illustrative embodiment, a contact 662 is arranged in circuit 600 in series with rotation detectors 604, 606, as shown in FIG. 12, and is configured to block or allow a flow of current through rotation detectors 604, 606 in response to signals from a relay 664, as shown in FIG. 12A. An oscillator 660 selectively applies power to relay 664 and controls a timing of signals from relay 664. Contact 662 is biased toward a closed position to allow current to flow through rotation detectors 604, 606 and apply power to motor 532 as described herein with respect to circuit 200.

Oscillator 660 intermittently powers relay 664 to signal contact 662 to open and stop the supply of power to motor 532 as suggested in FIGS. 12 and 12A. In some embodiments, contact 662 is opened and closed in a repeating pattern. In some embodiments, the time of each open and closed interval of contact 662 in the pattern is the same. In some embodiments, contact 662 is operated in a repeating pattern being closed for five (5) seconds and opened for one (1) second. In other embodiments, longer or shorter time intervals are used. In some embodiments, the closed intervals of contact 662 are longer, shorter, or the same as the open intervals of contact 662.

In the illustrative embodiment, motorized yo-yo 510 includes a selector 537 as shown in FIG. 10. Selector 537 allows a user of motorized yo-yo 510 to select an amount of time that drive mechanism 511 is powered during use of motorized yo-yo 510. A timer of rotation controller 513 can be activated by selector 537 at the selection of a user and allow power to be supplied to drive mechanism 511 for a predetermined interval of time. At the end of the time interval power is no longer supplied to the drive mechanism 511, allowing the motorized yo-yo 510 to be more easily returned to the user's hand. The time interval gives a concise or defined moment of opportunity for the motorized yo-yo 510 to return to the user's hand. This auto-return function helps develop a play pattern selectable by the user. Additionally the timer function can reverse polarity of the motor and trigger an "auto-return" function.

Figure 13:
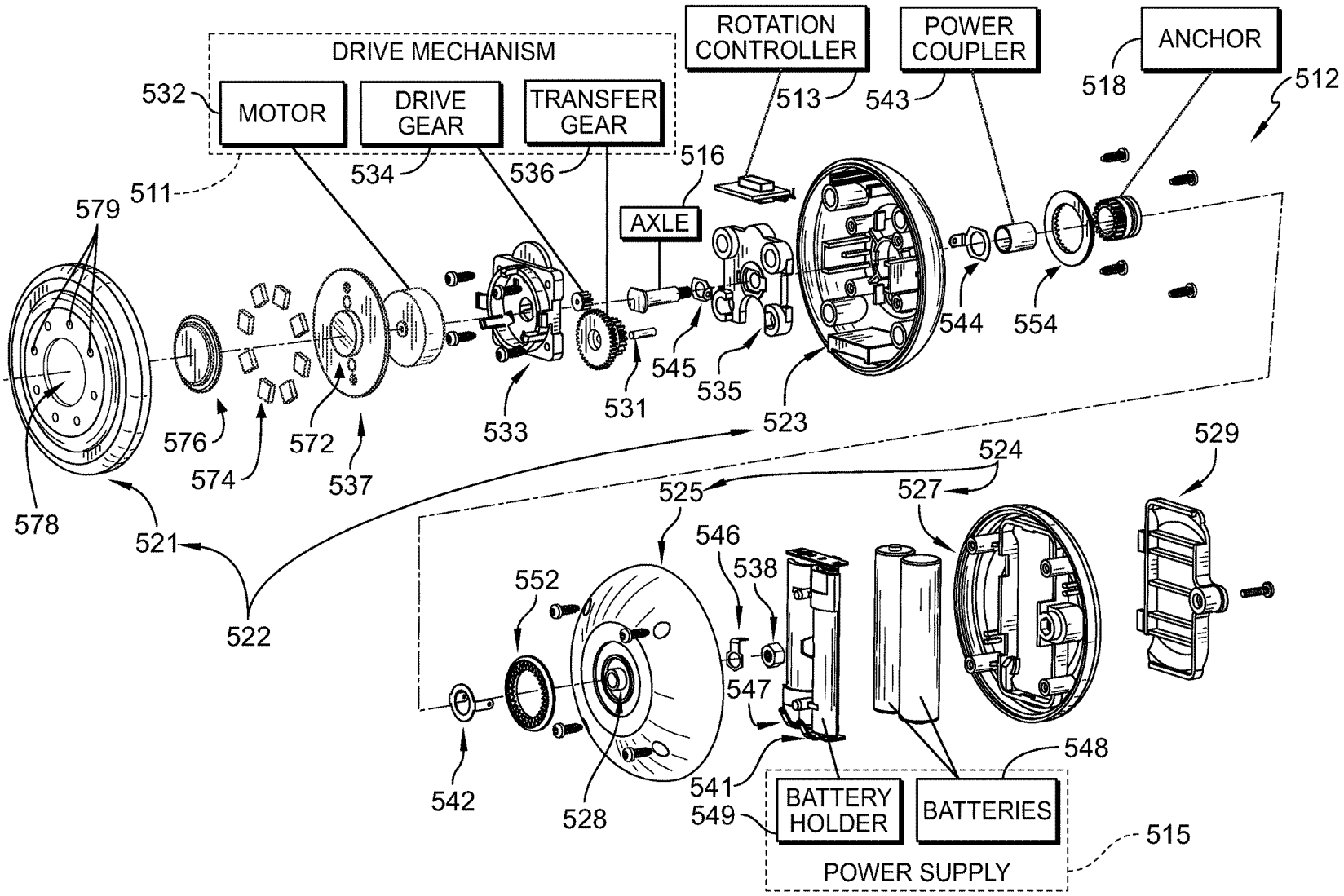
FIG. 13 is an exploded perspective view of the motorized yo-yo of FIG. 10 showing that a selector switch and indicator lights are positioned relative to a cover of the body for activation of a rotation controller by a user.
Figure 14:
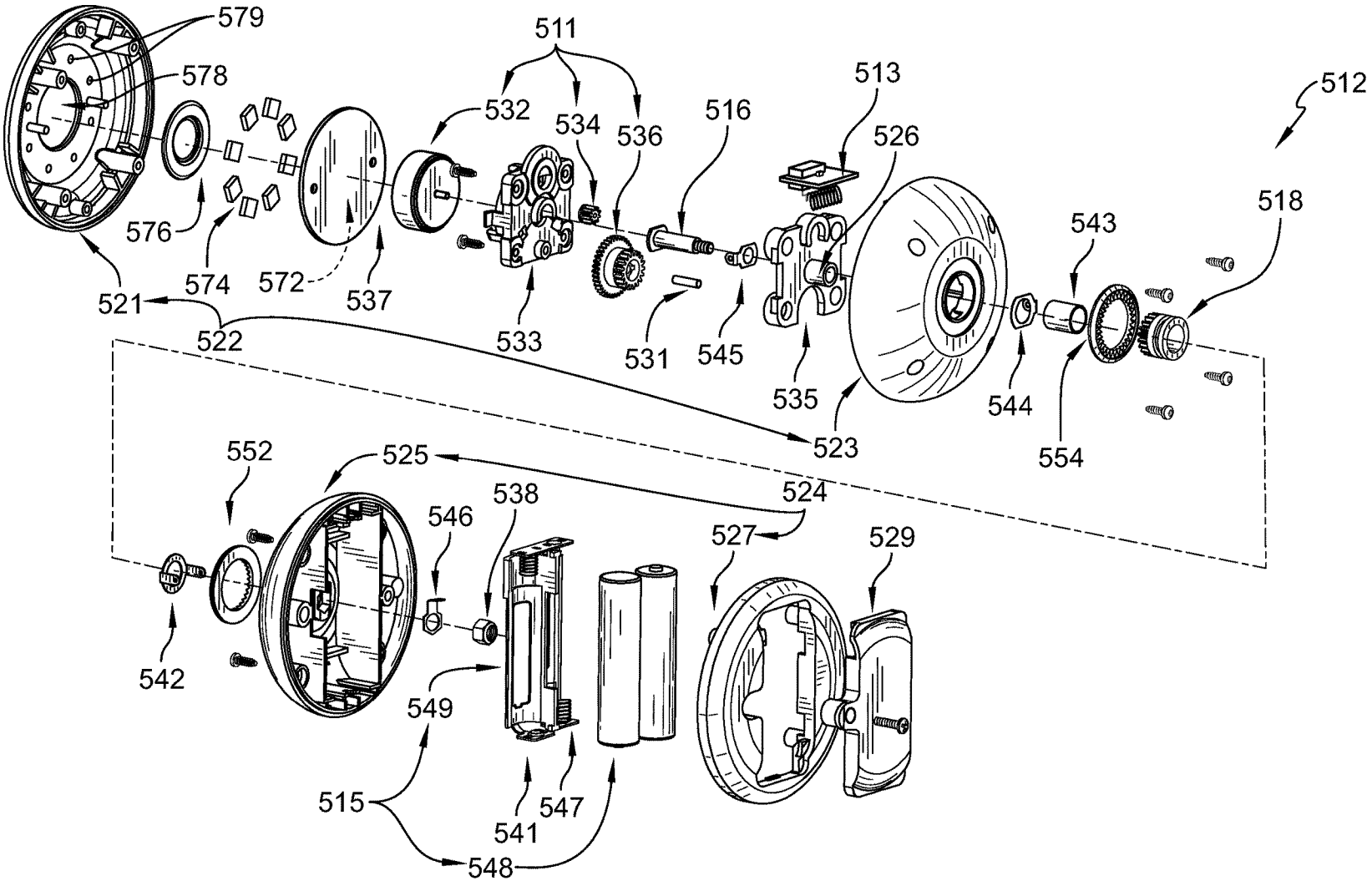
FIG. 14 is a view similar to FIG. 13.

Selector 537 includes a switch 572, indicators 574, and a button 576 as shown in FIGS. 13 and 14. Button 576 is positioned relative to an opening 578 in a cover 521 of drive-side housing 522 to allow a user to depress button 576 and engage switch 572. Indicators 574 are aligned with windows 579 so that light produced by indicators 574 is visible to a user. In some embodiments, indicators 574 are light emitting diodes. In some embodiments, indicators 574 are lamps or other light emitting devices. In the illustrative embodiment, each indicator 574 corresponds to a selectable time interval for powering drive mechanism 511. Switch 572 is operably connected to rotation controller 513 to signal a selected time interval for powering of drive mechanism 511.

In one illustrative embodiment, a user depresses button 576 to engage switch 572 and select a first time interval for operation of motorized yo-yo 510. A first indicator 574 illuminates to indicate to the user that the first time interval has been selected. Rotation controller 513 receives a signal from switch 572 that indicates the first time interval has been selected and rotation controller 513 prepares to supply power to drive mechanism 511 for the first time interval after the user throws motorized yo-yo 510 as described herein. Likewise, a second depression of button 576 allows the user to select a second time interval for operation of motorized yo-yo 510, illuminating a second indicator 574, and signaling rotation controller 513 to operate motorized yo-yo 510 for the second time interval. Each additional depression of button 576 allows the user to select a subsequent time interval. In some embodiments, the time intervals are preprogrammed into rotation controller 513. In some embodiments, motorized yo-yo 510 includes an interface to allow a user to program a desired time interval into rotation controller 513. The timer function can reverse polarity of the motor and trigger an "auto-return" function at the end of the time interval.

In one illustrative embodiment, eight (8) time intervals are programmed into rotation controller 513 for selection by a user, such as 10 seconds, 30 seconds, one (1) minute, three (3) minutes, 10 minutes, 30 minutes, one (1) hour, or an "infinite" time so long as power supply 515 can provide power to drive mechanism 511. In some embodiments, more or less time intervals can be selected. In some embodiments, shorter or longer time intervals can be selected. In some embodiments, a user can depress button 576 through all available time periods, and an additional depression of button 576 cancels the selection process. In some embodiments, power is pulsed to drive mechanism 511 as described herein during operation of motorized yo-yo 510 in a selected time interval. In some embodiments, power is not pulsed to drive mechanism 511 during a selected time interval.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation to encompass all such modifications and equivalent structures and functions.

The invention claimed is:

1. A yo-yo comprising:

a body;

an axle coupled to the body;

an anchor positioned on the axle;

a tether coupled to the anchor and configured to support the body for rotation about an axis relative to the anchor;

a drive mechanism housed in the body;

a power supply housed in the body and operatively coupled to the drive mechanism; and a rotation controller housed in the body and operatively coupled to the drive mechanism and the power supply, the controller configured to sense a direction of rotation of the body based on a polarity of a voltage produced by the drive mechanism during rotation of the body relative to the anchor and to apply voltage from the power supply to the drive mechanism having the same polarity such that the drive mechanism applies a force to the anchor to drive the body in the direction of rotation, wherein the controller is further configured to pulse the application of voltage to the drive mechanism to intermittently stop the application of force to the anchor by the drive mechanism in the direction of rotation.

2. The yo-yo of claim 1, wherein the body includes a drive-side housing and a power-side housing, and wherein the drive-side housing is coupled to the power-side housing by an axle.

3. The yo-yo of claim 2, wherein the drive mechanism is housed in the drive-side housing, and wherein the power supply is housed in the power-side housing.

4. The yo-yo of claim 3, further comprising a power coupling extending between the drive-side housing and power-side housing around the axle, wherein the power coupling is insulated relative to the axle, and wherein the power supply, rotation controller, and drive mechanism are operatively coupled to the axle and the power coupling to transmit power between the power supply, rotation controller, and drive mechanism.

5. The yo-yo of claim 1, wherein a control circuit of the rotation controller includes a clockwise rotation detector operatively coupled to the drive mechanism and a counter-clockwise rotation detector operatively coupled to the drive mechanism, wherein a positive voltage is produced by the drive mechanism in response to clockwise rotation of the body and a negative voltage is produced by the drive mechanism in response to counter-clockwise rotation of the body, wherein a resulting current of the positive voltage passes through the clockwise rotation detector to close a first set of contacts to allow a corresponding positive voltage to be applied to the drive mechanism by the power supply, and wherein a resulting current of the negative voltage passes through the counter-clockwise rotation detector to close a second set of contacts to allow a corresponding negative voltage to be applied to the drive mechanism by the power supply.

6. The yo-yo of claim 5, wherein the control circuit further includes a centrifugal switch configured to operatively connect the power supply to the drive mechanism in a closed position and to operatively disconnect the power supply from the drive mechanism in an opened position, wherein the centrifugal switch moves to the closed position in response to the body being thrown by a user to begin rotation of the body, and wherein the centrifugal switch moves to the opened position in response to the body being returned by the user to stop rotation of the body.

7. The yo-yo of claim 6, wherein the control circuit further includes a lamp configured to illuminate in response to the centrifugal switch moving to the closed position.

8. The yo-yo of claim 5, wherein each of the clockwise rotation detector and counter-clockwise rotation detector includes a diode and a relay coil, wherein the diode of the clockwise rotation detector allows resulting current of the positive voltage to pass through the clockwise rotation detector and blocks resulting current of the negative voltage from passing through the clockwise rotation detector, wherein the diode of the counter-clockwise rotation detector allows resulting current of the negative voltage to pass through the counter-clockwise rotation detector and blocks resulting current of the positive voltage from passing through the counter-clockwise rotation detector, and wherein each of the relay coils is configured to close a corresponding on of the first or second set of contacts when the relay coil is energized.

9. The yo-yo of claim 5, wherein each of the clockwise rotation detector and counter-clockwise rotation detector includes a pair of light emitting diodes, wherein the light emitting diodes of the clockwise rotation detector allows resulting current of the positive voltage to pass through the clockwise rotation detector and blocks resulting current of the negative voltage from passing through the clockwise rotation detector, wherein the light emitting diodes of the counter-clockwise rotation detector allows resulting current of the negative voltage to pass through the counter-clockwise rotation detector and blocks resulting current of the positive voltage from passing through the counter-clockwise rotation detector, and wherein each of the light emitting diodes is configured to close one corresponding contact of the first or second set of contacts when the light emitting diode is energized.

10. The yo-yo of claim 9, wherein each contact of the first and second sets of contacts is a metal oxide semiconductor field effect transistor.

11. The yo-yo of claim 9, wherein the control circuit further includes a speed controller operatively coupled between the power supply and the drive mechanism, wherein the speed controller includes a selector switch and a voltage reducer, wherein the selector switch is movable between a first position and a second position, wherein the selector switch is configured to pass current through the voltage reducer in the first position and to bypass current around the voltage reducer in the second position, and wherein the voltage reducer is configured to reduce voltage applied to the drive mechanism by the power supply to reduce a rotational speed of the body produced by the drive mechanism.

12. The yo-yo of claim 5, wherein the control circuit further includes a contact arranged in series with the clockwise and counter-clockwise rotation detectors, a relay, and an oscillator coupled to the relay, wherein the contact is configured to open in response to signals from the relay and stop application of voltage to the drive mechanisms, and the oscillator is configured to selectively and intermittently power the relay to produce the signals.

13. The yo-yo of claim 1, further comprising a selector coupled to the body, wherein the selector is operatively connected to the rotation controller, wherein the selector is configured to be engaged by a user to allow a user to select a predetermined amount of time, and wherein the rotation controller is configured to supply voltage to the drive mechanism for the predetermined amount of time at the selection of a user.

14. A yo-yo comprising:

a body;

an axle coupled to the body;

an anchor positioned on the axle and adapted to rotate with respect to the axle about an axis of rotation;

a tether coupled to the anchor and configured to support the body for rotation about the axis relative to the anchor;

a drive mechanism housed in the body, the drive mechanism adapted to cause rotation of the body with respect to the anchor;

a power supply housed in the body and operatively coupled to the drive mechanism; and a rotation controller housed in the body and operatively coupled to the drive mechanism and the power supply, the controller configured to sense a direction of rotation of the body based on a polarity of a voltage produced by the drive mechanism during rotation of the body relative to the anchor and to apply voltage from the power supply to the drive mechanism having the same polarity such that the drive mechanism applies a force to the anchor to drive the body in the direction of rotation, wherein the controller is further configured to pulse the application of voltage to the drive mechanism to intermittently stop the application of force to the anchor by the drive mechanism in the direction of rotation.

15. The yo-yo of claim 14, wherein the anchor includes a groove adapted to accept the tether and gear teeth adapted to engage transfer gears that are powered by an electric motor of the drive mechanism.

16. The yo-yo of claim 14, wherein the body includes a first housing and a spaced apart second housing, and wherein a portion of the axle and anchor are positioned between the first and second housings.

17. The yo-yo of claim 16, wherein the first housing includes the drive mechanism and the second housing includes the power supply.

18. The yo-yo of claim 14, further comprising a selector coupled to the body, wherein the selector is operatively connected to the rotation controller, wherein the selector is configured to be engaged by a user to allow a user to select a predetermined amount of time, and wherein the rotation controller is configured to supply voltage to the drive mechanism for the predetermined amount of time at the selection of a user.

19. A yo-yo comprising:

a body having first and second housings;

an anchor positioned between the housings and adapted to rotate with respect to the housings;

a tether coupled to the anchor and configured to support the body for rotation about an axis of rotation relative to the anchor;

a drive mechanism located in one of the first or second housings, the drive mechanism adapted to cause rotation of the body with respect to the anchor;

a power supply located in one of the first or second housings and operatively coupled to the drive mechanism; and a rotation controller located in one of the first or second housings and operatively coupled to the drive mechanism and the power supply, the controller configured to sense a direction of rotation of the body based on a polarity of a voltage produced by the drive mechanism during rotation of the body relative to the anchor and to apply voltage from the power supply to the drive mechanism having the same polarity such that the drive mechanism applies a force to the anchor to drive the body in the direction of rotation, wherein the controller is further configured to pulse the application of voltage to the drive mechanism to intermittently stop the application of force to the anchor by the drive mechanism in the direction of rotation.

20. The yo-yo of claim 19, further comprising a selector coupled to the body, wherein the selector is operatively connected to the rotation controller, wherein the selector is configured to be engaged by a user to allow a user to select a predetermined amount of time, and wherein the rotation controller is configured to supply voltage to the drive mechanism for the predetermined amount of time at the selection of a user.

* * * * *